US005666776A

United States Patent [19]

Weaver et al.

[11] Patent Number: 5,666,776

[45] Date of Patent: *Sep. 16, 1997

[54] LAMINATED ROOFING SHINGLE

[75] Inventors: Casimir Paul Weaver, Northport, Ala.; Matti Kiik, Richardson, Tex.; William J. Schultz, St. Charles, Ill.; Patrick T. Stapleton, Plymouth, Minn.

[73] Assignee: Elk Corporation of Dallas, Dallas, Tex.

[ * ] Notice: The term of this patent shall not extend beyond the expiration date of Pat. No. 5,369,929.

[21] Appl. No.: 521,235

[22] Filed: Aug. 30, 1995

Related U.S. Application Data

[63] Continuation of Ser. No. 318,901, Oct. 5, 1994, abandoned, which is a continuation of Ser. No. 189,796, Feb. 1, 1994, Pat. No. 5,369,929, which is a continuation-in-part of Ser. No. 762,857, Sep. 18, 1991, Pat. No. Des. 344,144.

[51] Int. Cl.[6] ..... E04D 1/28

[52] U.S. Cl. ..... 52/557; 52/314; 52/518; 52/554

[58] Field of Search ..... 52/314, 315, 554, 52/555, 557, 518

[56] References Cited

U.S. PATENT DOCUMENTS

| | | |
|---|---|---|
| D. 102 | 8/1846 | Rickerby . |
| D. 2,297 | 5/1866 | Clark et al. . |
| D. 15,359 | 8/1884 | Strover . |
| 19,880 | 4/1858 | Smith . |
| D. 20,695 | 4/1891 | Frand . |
| Re. 24,246 | 12/1956 | Fink . |
| D. 35,195 | 10/1901 | Barrett . |
| D. 35,592 | 1/1902 | Murdock . |
| D. 38,931 | 12/1907 | Dickelman . |
| D. 39,890 | 3/1909 | Pedlar . |
| D. 41,353 | 5/1911 | Vogan . |
| D. 42,101 | 1/1912 | Annis . |
| D. 45,836 | 5/1914 | Goldberg . |
| D. 48,172 | 11/1915 | Dunlany . |
| D. 51,438 | 10/1917 | Caron . |
| D. 52,538 | 10/1918 | Lords . |
| D. 53,015 | 2/1919 | Overbury et al. . |
| D. 53,086 | 3/1919 | Overbury . |
| D. 53,087 | 3/1919 | Overbury . |

(List continued on next page.)

FOREIGN PATENT DOCUMENTS 0963626 3/1975 Canada .

OTHER PUBLICATIONS

Eighteen photographs of shingles as a result of several focus group surveys on a wide variety of shingles, conducted by BJS III Marketing of Duncanville, Texas.

*Contractors Guide,* Aug. 1988—Georgia Pacific Advertisement.

(List continued on next page.)

*Primary Examiner*—Carl D. Friedman
*Assistant Examiner*—Kevin D. Wilkens
*Attorney, Agent, or Firm*—Baker & Botts, L.L.P.

[57] ABSTRACT

A shingle having a headlap section and a buttlap section with at least one portion of the buttlap section having a relatively uniform color and another portion of the buttlap section having a color gradient or gradation from light to dark. An illusion of depth or thickness is created on the portion of the buttlap section having the color gradient. The buttlap section defines in part the exposed weather surface of the associated shingle. The relatively uniform color portions may be formed on tabs or dragon teeth and the color gradient formed on a backer sheet disposed beneath the tabs. Openings between adjacent tabs expose the color gradient to view. A plurality of horizontal striations may be used to establish the desired color gradient from light to dark. The amount of tone and contrast may be selected to create the desired illusion of depth or thickness. The amount of contrast may be varied depending upon the color selected for each shingle. The number of horizontal striations and their width may also be varied to provide the desired color gradient.

5 Claims, 3 Drawing Sheets

U.S. PATENT DOCUMENTS

| | | |
|---|---|---|
| D. 53,102 | 3/1919 | Creighton . |
| D. 53,103 | 3/1919 | Creighton . |
| D. 54,160 | 11/1919 | Woodruff . |
| D. 54,917 | 4/1920 | Heppes . |
| D. 56,106 | 8/1920 | Russell . |
| D. 57,865 | 5/1921 | Scharwath . |
| D. 57,866 | 5/1921 | Scharwath . |
| D. 61,363 | 8/1922 | Butterick . |
| D. 67,565 | 6/1925 | Abbey et al. . |
| D. 68,522 | 10/1925 | Dohm . |
| D. 68,552 | 10/1925 | Sjodahl . |
| D. 70,986 | 8/1926 | Sjodhal . |
| D. 70,987 | 8/1926 | Sjodahl . |
| D. 70,988 | 8/1926 | Sjodahl . |
| D. 70,989 | 8/1926 | Sjodahl . |
| D. 74,467 | 2/1928 | Abraham . |
| D. 74,669 | 3/1928 | Fife . |
| D. 75,433 | 6/1928 | Kelly . |
| D. 75,612 | 6/1928 | Cotner . |
| D. 75,761 | 7/1928 | Abraham . |
| D. 75,762 | 7/1928 | Abraham . |
| D. 76,843 | 11/1928 | Topping . |
| D. 77,213 | 12/1928 | Abraham . |
| D. 77,218 | 12/1928 | Caron . |
| D. 77,277 | 12/1928 | Welch . |
| D. 77,786 | 2/1929 | Melby . |
| D. 81,200 | 5/1930 | Naterman . |
| D. 81,712 | 7/1930 | Moone . |
| D. 81,768 | 8/1930 | Topping . |
| D. 83,624 | 3/1931 | Ledeboer . |
| D. 83,704 | 3/1931 | Stark . |
| D. 83,718 | 3/1931 | Brown . |
| D. 84,668 | 7/1931 | Ralph . |
| D. 85,638 | 12/1931 | Finley . |
| D. 85,639 | 12/1931 | Finley . |
| D. 86,085 | 1/1932 | Guy . |
| D. 86,194 | 2/1932 | Brown . |
| D. 87,104 | 6/1932 | Eckert . |
| D. 88,995 | 1/1933 | Tobin . |
| D. 89,471 | 3/1933 | Streeter et al. . |
| D. 89,639 | 4/1933 | Humphrey . |
| D. 89,783 | 5/1933 | Moone . |
| D. 90,115 | 6/1933 | Harshberger . |
| D. 91,061 | 11/1933 | Fife . |
| D. 91,654 | 3/1934 | Harshberger . |
| D. 91,744 | 3/1934 | Topping . |
| D. 92,132 | 5/1934 | Holdsworth . |
| D. 92,250 | 4/1934 | Harshberger . |
| D. 92,379 | 5/1934 | Topping . |
| D. 92,380 | 5/1934 | Topping . |
| D. 92,504 | 6/1934 | Topping . |
| D. 92,632 | 6/1934 | Topping . |
| D. 93,191 | 8/1934 | Topping . |
| D. 93,642 | 10/1934 | Topping . |
| D. 95,242 | 4/1935 | Goslin . |
| D. 95,731 | 5/1935 | Cahill et al. . |
| D. 95,824 | 11/1935 | Harshberger . |
| D. 96,547 | 8/1935 | Harshberger . |
| D. 99,248 | 4/1936 | Piazza . |
| D. 99,249 | 4/1936 | Piazza . |
| D. 101,732 | 10/1936 | Clow . |
| D. 101,921 | 11/1936 | MacLean . |
| D. 104,095 | 4/1937 | Fife . |
| D. 104,948 | 6/1937 | Mickelson . |
| D. 104,971 | 6/1937 | Logan . |
| D. 105,124 | 6/1937 | Molyneux . |
| D. 107,209 | 11/1937 | Batell . |
| D. 109,077 | 3/1938 | Foley . |
| D. 112,998 | 1/1939 | Hunker . |
| D. 119,439 | 3/1940 | Ritter . |
| 121,063 | 11/1871 | Pierce . |
| 126,547 | 5/1872 | Hickcox . |
| D. 127,883 | 6/1941 | Johnston . |
| D. 131,018 | 1/1942 | Coburn . |
| D. 135,035 | 2/1943 | Humphrey . |
| D. 135,045 | 2/1943 | Bigler et al. . |
| D. 142,479 | 10/1945 | Heinning . |
| D. 143,400 | 1/1946 | Coburn . |
| D. 143,401 | 1/1946 | Coburn . |
| D. 143,402 | 1/1946 | Coburn . |
| D. 143,403 | 1/1946 | Coburn . |
| D. 143,404 | 1/1946 | Coburn . |
| D. 144,378 | 4/1946 | Harris . |
| D. 153,983 | 5/1949 | Rysdon . |
| D. 160,866 | 11/1950 | Kellogg . |
| D. 161,210 | 12/1950 | Ruggles . |
| D. 161,945 | 2/1951 | Lorenz . |
| D. 164,271 | 8/1951 | Abraham . |
| D. 164,317 | 8/1951 | Papesh . |
| D. 166,761 | 5/1952 | Langville . |
| D. 167,474 | 8/1952 | Nettles . |
| D. 168,668 | 1/1953 | Berini . |
| D. 173,327 | 10/1954 | Robert . |
| D. 173,332 | 10/1954 | Volk . |
| D. 177,808 | 5/1956 | Helt et al. . |
| D. 178,450 | 8/1956 | Butler . |
| D. 182,401 | 4/1958 | Borger et al. . |
| D. 186,086 | 9/1959 | Hadders . |
| 188,447 | 3/1877 | Walton . |
| D. 195,334 | 6/1963 | Brockman . |
| D. 199,939 | 12/1964 | Sewell . |
| D. 200,299 | 2/1965 | Pannullo et al. . |
| D. 208,294 | 8/1967 | Dallaire . |
| D. 208,887 | 10/1967 | Gillis . |
| D. 209,719 | 12/1967 | Ellis . |
| D. 211,214 | 5/1968 | Bull . |
| D. 212,874 | 12/1968 | Tiverton et al. . |
| D. 222,119 | 9/1971 | Green . |
| D. 235,254 | 6/1975 | Luther . |
| D. 247,786 | 4/1978 | Flood . |
| D. 250,848 | 1/1979 | Naslund . |
| D. 251,808 | 5/1979 | Patenaude . |
| D. 256,953 | 9/1980 | Morita . |
| D. 256,954 | 9/1980 | Morita . |
| D. 265,510 | 7/1982 | Bedwell, Jr. . |
| D. 272,767 | 2/1984 | Nemeth . |
| D. 274,947 | 7/1984 | Culpepper, Jr. et al. . |
| D. 277,411 | 1/1985 | Spinelli et al. . |
| D. 282,287 | 1/1986 | McKeagan et al. . |
| D. 288,771 | 3/1987 | Kero . |
| D. 300,257 | 3/1989 | Stahl . |
| D. 309,027 | 7/1990 | Noone et al. . |
| D. 313,278 | 12/1990 | Noone . |
| D. 313,658 | 1/1991 | Noone . |
| D. 314,439 | 2/1991 | Jenkins et al. . |
| D. 314,628 | 2/1991 | Jenkins et al. . |
| 315,061 | 4/1885 | Perkins . |
| D. 317,506 | 6/1991 | Jenkins et al. . |
| D. 320,091 | 9/1991 | Paquette . |
| D. 326,330 | 5/1992 | Klein . |
| D. 331,812 | 12/1992 | Bunger . |
| 335,342 | 2/1886 | Daugherty . |
| D. 336,347 | 6/1993 | Hannah et al. . |
| D. 339,875 | 9/1993 | Schutz et al. . |
| D. 340,294 | 10/1993 | Hannah et al. . |
| D. 341,667 | 11/1993 | Schultz et al. . |
| D. 344,144 | 2/1994 | Weaver et al. . |
| D. 347,900 | 6/1994 | Stapleton . |
| 553,514 | 1/1896 | Crawford . |
| 614,478 | 11/1898 | Johnston . |
| 716,585 | 12/1902 | Schneider . |
| 748,141 | 12/1903 | Zwerk . |

| | | |
|---|---|---|
| 876,098 | 1/1908 | Savery . |
| 891,501 | 6/1908 | Overbury . |
| 957,623 | 5/1910 | Oesterheld . |
| 978,333 | 12/1910 | Overbury . |
| 1,096,267 | 5/1914 | Sammis . |
| 1,108,236 | 8/1914 | Reynolds . |
| 1,115,866 | 11/1914 | Reynolds . |
| 1,150,298 | 8/1915 | Overbury . |
| 1,154,334 | 9/1915 | Overbury . |
| 1,157,665 | 10/1915 | Becker . |
| 1,208,595 | 12/1916 | McKay . |
| 1,219,652 | 3/1917 | McKay . |
| 1,256,384 | 2/1918 | Simonson . |
| 1,295,360 | 2/1919 | Overbury . |
| 1,318,238 | 10/1919 | Speer . |
| 1,345,627 | 7/1920 | Overbury . |
| 1,351,181 | 8/1920 | McKay . |
| 1,368,947 | 2/1921 | Levis . |
| 1,379,368 | 5/1921 | Speer . |
| 1,389,979 | 9/1921 | Rahr et al. . |
| 1,410,867 | 3/1922 | Abraham . |
| 1,414,778 | 5/1922 | Elvidge . |
| 1,425,564 | 8/1922 | Whiteside . |
| 1,431,103 | 10/1922 | Donahue . |
| 1,434,332 | 10/1922 | Elvidge . |
| 1,442,614 | 1/1923 | Hooker . |
| 1,443,774 | 1/1923 | Weber . |
| 1,450,731 | 4/1923 | Maclean . |
| 1,464,492 | 8/1923 | Busha . |
| 1,464,493 | 8/1923 | Busha . |
| 1,464,494 | 8/1923 | Busha . |
| 1,466,077 | 8/1923 | Wardell . |
| 1,467,779 | 9/1923 | Dremann . |
| 1,472,270 | 10/1923 | Harshberger . |
| 1,483,046 | 2/1924 | Ritter . |
| 1,494,788 | 5/1924 | Kromenaker et al. . |
| 1,494,789 | 5/1924 | Abraham . |
| 1,495,070 | 5/1924 | Finley . |
| 1,496,108 | 6/1924 | Wilson et al. . |
| 1,508,365 | 9/1924 | Lukens, Jr. et al. . |
| 1,516,243 | 11/1924 | Perry . |
| 1,518,857 | 12/1924 | Layton . |
| 1,533,969 | 4/1925 | Busha . |
| 1,544,956 | 7/1925 | Torbert . |
| 1,555,441 | 9/1925 | Sjodahl . |
| 1,582,281 | 4/1926 | Kridler et al. . |
| 1,584,023 | 5/1926 | Fischer . |
| 1,601,731 | 10/1926 | Flood . |
| 1,604,339 | 10/1926 | Cumfer . |
| 1,604,708 | 10/1926 | Mills, Jr. . |
| 1,604,745 | 10/1926 | Finley . |
| 1,612,776 | 12/1927 | Kirschbraun . |
| 1,627,665 | 5/1927 | Overbury . |
| 1,629,146 | 5/1927 | Busha . |
| 1,629,287 | 5/1927 | Milligan . |
| 1,631,936 | 6/1927 | Ritter . |
| 1,633,474 | 6/1927 | Busha . |
| 1,638,746 | 8/1927 | Robinson . |
| 1,642,148 | 9/1927 | Guy . |
| 1,648,692 | 11/1927 | McCarthy . |
| 1,650,285 | 11/1927 | Lindley . |
| 1,655,885 | 1/1928 | Adair . |
| 1,657,271 | 1/1928 | Nelson . |
| 1,666,429 | 4/1928 | Stolp, Jr. . |
| 1,672,713 | 6/1928 | Durbin . |
| 1,690,792 | 11/1928 | Neptune . |
| 1,701,640 | 2/1929 | Sherriff . |
| 1,705,497 | 3/1929 | Overbury . |
| 1,722,702 | 7/1929 | Kirschbraun et al. . |
| 1,729,212 | 9/1929 | Fischer . |
| 1,741,403 | 12/1929 | Caton . |
| 1,741,539 | 12/1929 | Richardson . |
| 1,741,566 | 12/1929 | Harris . |
| 1,742,724 | 1/1930 | Perry . |
| 1,748,981 | 3/1930 | Harris . |
| 1,756,476 | 4/1930 | Audet . |
| 1,765,796 | 6/1930 | Kirschbraun . |
| 1,767,374 | 6/1930 | Kirschbraun . |
| 1,768,280 | 6/1930 | Arcidiacono . |
| 1,772,487 | 8/1930 | Horne . |
| 1,772,924 | 8/1930 | Weller . |
| 1,776,949 | 9/1930 | Lumbard . |
| 1,791,571 | 2/1931 | Overbury . |
| 1,794,719 | 3/1931 | MacLean . |
| 1,800,403 | 4/1931 | Pfaff et al. . |
| 1,802,868 | 4/1931 | Black . |
| 1,805,292 | 5/1931 | Mosher . |
| 1,825,576 | 9/1931 | Butterick . |
| 1,842,761 | 1/1932 | McCarthy . |
| 1,843,370 | 2/1932 | Overbury . |
| 1,846,635 | 2/1932 | Finley . |
| 1,850,680 | 3/1932 | Levin . |
| 1,857,463 | 5/1932 | MacLean . |
| 1,862,852 | 6/1932 | Harshberger . |
| 1,873,944 | 8/1932 | Black . |
| 1,898,989 | 2/1933 | Harshberger . |
| 1,913,768 | 6/1933 | Moone . |
| 1,915,964 | 6/1933 | Wall . |
| 1,920,474 | 8/1933 | Martin . |
| 1,924,650 | 8/1933 | Payne . |
| 1,927,436 | 9/1933 | Fischer . |
| 1,928,285 | 9/1933 | Fischer . |
| 1,928,835 | 10/1933 | Levis . |
| 1,935,656 | 11/1933 | Mortimer . |
| 1,936,327 | 11/1933 | Fischer . |
| 1,937,933 | 12/1933 | Yeager . |
| 1,958,560 | 5/1934 | Beckman . |
| 1,959,960 | 5/1934 | Magrath . |
| 1,961,005 | 5/1934 | Levin . |
| 1,974,047 | 9/1934 | Harshberger . |
| 1,993,134 | 3/1935 | Ford . |
| 1,994,643 | 3/1935 | Harshberger . |
| 2,006,270 | 6/1935 | Harshberger . |
| 2,013,002 | 9/1935 | Logan . |
| 2,013,391 | 9/1935 | Searls . |
| 2,035,921 | 3/1936 | Quinn . |
| 2,036,329 | 4/1936 | Giles . |
| 2,037,507 | 4/1936 | Fischer . |
| 2,045,423 | 6/1936 | Topping . |
| 2,050,218 | 8/1936 | Abraham . |
| 2,051,818 | 8/1936 | Buczkowski . |
| 2,058,578 | 10/1936 | Eckert . |
| 2,068,118 | 1/1937 | Topping . |
| 2,068,767 | 1/1937 | Robert . |
| 2,070,571 | 2/1937 | Beasley . |
| 2,074,684 | 3/1937 | Eckert . |
| 2,075,058 | 3/1937 | Robinson . |
| 2,078,998 | 5/1937 | Black . |
| 2,084,981 | 6/1937 | Anderson . |
| 2,086,137 | 7/1937 | Ritter . |
| 2,094,059 | 9/1937 | Buczkowski . |
| 2,096,968 | 10/1937 | Johnston . |
| 2,097,546 | 11/1937 | Brown . |
| 2,099,131 | 11/1937 | Miller . |
| 2,100,830 | 11/1937 | Altheide . |
| 2,103,076 | 12/1937 | Harshberger et al. . |
| 2,104,067 | 1/1938 | Bailey . |
| 2,109,447 | 2/1938 | Sadtler . |
| 2,110,258 | 3/1938 | Blank . |
| 2,111,565 | 3/1938 | Limerick . |
| 2,111,798 | 3/1938 | Miller et al. . |
| 2,112,194 | 3/1938 | Harshberger . |
| 2,112,861 | 4/1938 | O'Hagen et al. . |
| 2,113,644 | 4/1938 | Bollaert . |

| | | |
|---|---|---|
| 2,114,450 | 4/1938 | MacLean . |
| 2,127,199 | 8/1938 | Austhoff . |
| 2,128,836 | 8/1938 | McVoy . |
| 2,129,288 | 9/1938 | Shattuck . |
| 2,131,043 | 9/1938 | Harshberger et al. . |
| 2,132,999 | 10/1938 | Topping . |
| 2,142,177 | 1/1939 | Clapp . |
| 2,142,181 | 1/1939 | Clapp . |
| 2,148,167 | 2/1939 | Lyman . |
| 2,150,883 | 3/1939 | O'Reilly . |
| 2,161,440 | 6/1939 | Venrick . |
| 2,168,217 | 8/1939 | Kirschbraun . |
| 2,168,955 | 8/1939 | Karan . |
| 2,170,534 | 8/1939 | MacNutt . |
| 2,171,010 | 8/1939 | Schuetz et al. . |
| 2,171,746 | 9/1939 | Guiterman . |
| 2,174,098 | 9/1939 | Stein . |
| 2,182,444 | 12/1939 | McKinnie . |
| 2,182,526 | 12/1939 | Rumer . |
| 2,187,139 | 1/1940 | Rowe . |
| 2,187,203 | 1/1940 | Johnston . |
| 2,190,654 | 2/1940 | Eichhorn . |
| 2,196,420 | 4/1940 | Matthews . |
| 2,196,847 | 4/1940 | Austin . |
| 2,197,972 | 4/1940 | Ernst . |
| 2,198,466 | 4/1940 | Stolze . |
| 2,199,760 | 5/1940 | Schuetz . |
| 2,201,175 | 5/1940 | Harshberger . |
| 2,201,442 | 5/1940 | Mabie, Jr. . |
| 2,202,830 | 6/1940 | Bussey . |
| 2,205,679 | 6/1940 | Ames, Jr. . |
| 2,206,915 | 7/1940 | Ochs . |
| 2,243,256 | 5/1941 | Miller . |
| 2,250,764 | 7/1941 | Hoess . |
| 2,253,662 | 8/1941 | Ritter . |
| 2,260,446 | 10/1941 | Fooks, Jr. et al. . |
| 2,276,170 | 3/1942 | Elmendorf . |
| 2,284,705 | 6/1942 | Wickersham . |
| 2,285,480 | 6/1942 | Wilde . |
| 2,290,420 | 7/1942 | Fasold . |
| 2,302,183 | 11/1942 | Burns . |
| 2,307,734 | 1/1943 | DeVault . |
| 2,323,230 | 6/1943 | McAvoy . |
| 2,335,493 | 11/1943 | Drinkall . |
| 2,336,191 | 12/1943 | Rose . |
| 2,340,038 | 1/1944 | Buczkowski et al. . |
| 2,347,250 | 4/1944 | Burnett . |
| 2,348,223 | 5/1944 | Papesh . |
| 2,370,803 | 3/1945 | Kronenbitter . |
| 2,371,180 | 3/1945 | Moeller . |
| 2,421,766 | 6/1947 | Turman . |
| 2,437,874 | 3/1948 | Black . |
| 2,438,099 | 3/1948 | Whitehouse . |
| 2,661,303 | 12/1953 | Fasold et al. . |
| 2,818,824 | 1/1958 | Read et al. . |
| 3,001,331 | 9/1961 | Brunton . |
| 3,091,898 | 6/1963 | Fasold et al. . |
| 3,104,184 | 9/1963 | Wengenroth . |
| 3,111,788 | 11/1963 | Ouellet . |
| 3,166,872 | 1/1965 | Cacossa . |
| 3,200,552 | 8/1965 | Steck . |
| 3,233,382 | 2/1966 | Graveley, Jr. . |
| 3,237,361 | 3/1966 | Norman, Jr. . |
| 3,247,631 | 4/1966 | Lovness . |
| 3,252,257 | 5/1966 | Price et al. . |
| 3,262,239 | 7/1966 | Mills . |
| 3,267,834 | 8/1966 | Hockett . |
| 3,269,075 | 8/1966 | Marini et al. . |
| 3,347,001 | 10/1967 | Cosden . |
| 3,363,380 | 1/1968 | Merrill . |
| 3,376,683 | 4/1968 | Epstein . |
| 3,377,762 | 4/1968 | Chalmers et al. . |
| 3,380,215 | 4/1968 | Schaefer et al. . |
| 3,407,556 | 10/1968 | Leibrook . |
| 3,412,518 | 11/1968 | Waite . |
| 3,422,589 | 1/1969 | Harrison . |
| 3,468,092 | 9/1969 | Chalmers . |
| 3,484,267 | 12/1969 | Sadler, III . |
| 3,507,079 | 4/1970 | George . |
| 3,593,479 | 7/1971 | Hinds et al. . |
| 3,605,369 | 9/1971 | Merrill et al. . |
| 3,613,328 | 10/1971 | Morgan, Jr. et al. . |
| 3,624,975 | 12/1971 | Morgan et al. . |
| 3,626,439 | 12/1971 | Kneisel . |
| 3,640,035 | 2/1972 | Butterfield . |
| 3,640,044 | 2/1972 | Watts . |
| 3,667,184 | 6/1972 | Merrill et al. . |
| 3,763,609 | 10/1973 | Probst . |
| 3,783,570 | 1/1974 | Storch . |
| 3,797,179 | 3/1974 | Jackson . |
| 3,897,667 | 8/1975 | Turek . |
| 3,899,855 | 8/1975 | Gadsby . |
| 3,903,340 | 9/1975 | Shepherd . |
| 3,919,823 | 11/1975 | Bradley . |
| 3,921,358 | 11/1975 | Bettoli ..... 52/314 |
| 3,927,501 | 12/1975 | Allen et al. . |
| 3,973,369 | 8/1976 | Smith . |
| 4,001,997 | 1/1977 | Saltzman . |
| 4,015,374 | 4/1977 | Epstein et al. . |
| 4,079,561 | 3/1978 | Vallee . |
| 4,143,499 | 3/1979 | Näslund . |
| 4,186,538 | 2/1980 | Marcum, Jr. . |
| 4,188,762 | 2/1980 | Tellman . |
| 4,188,763 | 2/1980 | Thiis-Evensen . |
| 4,194,335 | 3/1980 | Diamond . |
| 4,195,461 | 4/1980 | Thiis-Evensen . |
| 4,198,257 | 4/1980 | Pfaff . |
| 4,261,152 | 4/1981 | Tellman . |
| 4,262,466 | 4/1981 | Roe . |
| 4,266,388 | 5/1981 | Flood . |
| 4,274,243 | 6/1981 | Corbin et al. . |
| 4,295,445 | 10/1981 | Kopenhaver . |
| 4,301,633 | 11/1981 | Neumann . |
| 4,317,853 | 3/1982 | Thiis-Evensen . |
| 4,322,928 | 4/1982 | Freiborg . |
| 4,333,279 | 6/1982 | Corbin et al. . |
| 4,352,837 | 10/1982 | Kopenhaver . |
| 4,399,186 | 8/1983 | Lauderback . |
| 4,404,783 | 9/1983 | Freiborg . |
| 4,405,680 | 9/1983 | Hansen . |
| 4,468,903 | 9/1984 | Eaton et al. . |
| 4,468,909 | 9/1984 | Eaton . |
| 4,499,701 | 2/1985 | Bockwinkel et al. . |
| 4,499,702 | 2/1985 | Turner . |
| 4,527,374 | 7/1985 | Corbin . |
| 4,559,267 | 12/1985 | Freshwater et al. . |
| 4,571,356 | 2/1986 | White, Sr. et al. . |
| 4,611,451 | 9/1986 | Symbold . |
| 4,637,191 | 1/1987 | Smith . |
| 4,672,790 | 6/1987 | Freiborg . |
| 4,717,614 | 1/1988 | Bondoc et al. . |
| 4,729,814 | 3/1988 | Jennus et al. . |
| 4,768,318 | 9/1988 | Freiborg . |
| 4,817,358 | 4/1989 | Lincoln et al. . |
| 4,835,929 | 6/1989 | Bondoc et al. . |
| 4,848,057 | 7/1989 | MacDonald et al. . |
| 4,869,942 | 9/1989 | Jennus et al. . |
| 5,052,162 | 10/1991 | Bush et al. . |
| 5,181,361 | 1/1993 | Hannah et al. . |
| 5,195,290 | 3/1993 | Hulett . |
| 5,209,802 | 5/1993 | Hannah et al. . |
| 5,232,530 | 8/1993 | Malmquist et al. . |
| 5,369,929 | 12/1994 | Weaver et al. . |

OTHER PUBLICATIONS

Brochure, Residential Roofing Products "The Stars of our line are Helping Keep America Beautiful".
Advertisement, The Ruberoid Co., *American Builder,* Apr. 1952.
Advertisement, The Ruberoid Co., *Sweet's Catalogue File,* 1952.
The Ruberoid Co. Annual Report 1941 to Stockholders and Employees.
Advertisement, GAF Timberline "Natural Shadow" Timberline Series.
Advertisement, GAF "The Roof the Neighbors Look Up To".
Brochure, GAF Timberline Series Ultra "Natural Shadow", 1994.
Brochure, GAF Timberline Ultra "Natural Shadow", 1993.
Brochure, GAF Timberline Ultra "Natural Shadow" Color Selector, 1994.
Brochure, GAF "Natural Shadow", 1994.
Brochure, GAF, "The Roof the Neighbors Look Up To.", 1994.
Brochure, GAF, The GAF Timberline Series, "Natural Shadow, 1994".
Brochure, GAF Residential Roofing, 1993.
Celotex Brochure (2 pages), Jun. 1982.
Declaration of Matti Kiik dated Feb. 1, 1994.
*Roofs Catalogue by the Flintkote Company,* Jul. 1929, p. 20, slate–tone shingles illustration at top center.
1982 *Sweets* Catalogue File, Products for Light Residential Construction 7.7 Jo, p. 2 illustration.
1982 *Sweets* Catalogue File, Products for Light Residential Construction 7.7 Jo, p. 4, The Woodlands Roof.
Copy of *Carey® Fire–Chex Roofing* Catalogue Form No. 6295–57–956–NL (from 1957 Sweets Catalogue) (20 sheets).
Copy of *Carey® Fire–Chex Rustic Shake* Catalogue From 1967 Sweets Catalogue (47M–936–HC) (8 pages).
The Roofing Collection ®, CertainTeed, HORIZON Shangle®, 1991, CertainTeed Corporation.
*Asphalt Roofing Manufacturers Association,* "Residential Asphalt Roofing Manual," Cover page through 7, © 1984, 1988.
*Elk Corporation,* "Prestique ®, High Definition Shingles," ™ 1991 Elk Corporation.
*Contractors Guide,* Aug. 1988 Georgia Pacific Advertisement (2 sheets).
Brochure GS Roofing Products Company High Sierra™ Premier Heavyweight Laminated Shingles Advertisement (1 sheet).
Video entitled "3M/IMP Roofing Granules IMP".
Brochure Pabco Roofing Products "PABCO® HM–30™ Extra Protectoin, Durability and Beauty" (4 sheets).
Brochure Pabco Roofing Products "PABCO® HO–25™ Protection and Beauty Beyond the Ordinary" (2 sheets).
Brochure Pabco Roofing Products "PABCO® SG–25™ Extra Proecton and Longer Life" (2 sheets).
Brochure Pabco Roofing Products "PABCO® GG–20™ The Most Economical U/L Class 'A' Roof" (4 sheets).
Brochure Owens/Corning Fiberglas™ "Oakridge™ Dimensional Shingles" Apr. 1988 (10 sheets).
Brochure Atlas Roofing Corporation "Residential Roofing Products" pp. 1–8.
Brochure Dura Ridge (2 sheets).
Brochure TrendRidge® (2 sheets).
Brochure Tamko Roofing Products "Residential Roofing Products" 1990 (10 sheets).
Pages from "Tonal Values, How to See Them, How to Paint Them" by Angela Gair (cover page and pp. 6, 18, 29, 30 and 43).
Pages from North Light Art School, "Observation & Drawing" (cover page, front page and pp. 10, 11 and 33).
Brochure, Carey Fire Chex Roofing, Sep. 1966.
Brochure, Carey, The Philip Carey Manufacturing Company.
Picture, Fire–Chex 400.
Picture, Rustic Shakes.
Color copy of two photographs of pages from the 1966 *Philip Carey* Catalogue and the 1967 Sweets Catalogue (1 sheet).
Color copy of five photographs of pages from *Carey Fire–Chex Roofing* Catalogue, 1957.
*Sweets* Catalogue (2 sheets).
Color photograph of 3M three–tab shingle.

LAMINATED ROOFING SHINGLE

This application is a continuation of application Ser. No. 08/318,901, filed Oct. 5, 1994 by Casimir P. Weaver, Matti (nmi) Kiik, William J. Schultz and Patrick T. Stapleton and entitled *Laminated Roofing Shingle,* now abandoned, which was a continuation of application Ser. No. 08/189,796, filed Feb. 1, 1994 by Casimir P. Weaver, Matti (nmi) Kiik, William J. Schultz and Patrick T. Stapleton and entitled *Laminated Roofing Shingle,* now U.S. Pat. No. 5,369,929 issued Dec. 6, 1994; which is a continuation-in-part of Design patent application Ser. No. 07/762,857 filed Sep. 18, 1991 by the same inventors and entitled *Laminated Shingle,* now U.S. Design Patent 344,144, issued Feb. 8, 1994.

Application Ser. No. 08/347,032 was filed Nov. 30, 1994 by Casimir P. Weaver and entitled *Laminated Roofing Shingle,* now U.S. Pat. No. 5,611,186 issued Mar. 18, 1997, as a continuation-in-part from application Ser. No. 08/189,796, filed Feb. 1, 1994 by Casimir P. Weaver, Matti (nmi) Kiik, William J. Schultz and Patrick T. Stapleton and entitled *Laminated Roofing Shingle*, now U.S. Pat. No. 5,369,929 issued Dec. 6, 1994, which is a continuation-in-part of Design patent application Ser. No. 07/762,857 filed Sep. 18, 1991 by the same inventors and entitled Laminated Shingle, now U.S. Design Patent 344,144, issued Feb. 8, 1994.

TECHNICAL FIELD OF THE INVENTION

This invention relates to an improved roofing product, and in particular, to a shingle having a color gradient or gradation to create the illusion of thickness or depth on a relatively flat surface.

BACKGROUND OF THE INVENTION

Asphalt roofing products are often divided into three broad groups: shingles, roll roofing and underlayment. Shingles and roll roofing typically functions as outer roof coverings designed to withstand exposure to weather and the elements. Shingles and roll roofing generally contain the same basic components which provide protection and long term wear associated with asphalt roofing products. These components include a base material made from an organic felt or fiberglass mat which serves as a matrix to support the other components and gives the product the required strength to withstand manufacturing, handling, installation and service in the intended environment. An asphalt coating formulated for the particular service application is often applied to the base material to provide the desired long term ability to resist weathering and to provide stability under the anticipated temperature extremes. An outer layer of mineral granules is also commonly applied to the asphalt coating to form a surface exposed to the weather which shields the asphalt coating from the sun's rays, adds color to the final product and provides fire resistance.

Asphalt shingles are one of the most commonly used roofing materials. Such shingles are typically manufactured as strip shingles, interlocking shingles and large individual shingles in a variety of weights and colors. Such asphalt shingles are also often referred to as composite shingles. Even though composite and/or asphalt shingles offer significant cost, service life and flammability advantages over wood shingles, wood shingles are still often preferred due to the pleasing aesthetic appearance of a wood shingled roof. An important aesthetic advantage of such wood shingles is their greater thickness as compared to composite shingles. The thickness of wood shingles results in a more pleasing, layered look for the finished roof.

Various composite shingles have been developed to provide an appearance of thickness comparable to wood shingles. Examples of such composite or asphalt shingles are shown in U.S. Pat. No. 5,232,530 entitled *Method of Making a Thick Shingle;* U.S. Pat. No. 3,921,358 entitled *Composite Shingle;* U.S. Pat. No. 4,717,614 entitled *Asphalt Shingle;* and design and U.S. Pat. No. D309,027 entitled *Tab Portion of a Shingle.* These above-referenced patents are incorporated by reference for all purposes within this application. Also, the *Residential Asphalt Roofing Manual* published by the Asphalt Roofing Manufacturers Association provides excellent information on various types of shingles and other roofing products.

SUMMARY OF THE INVENTION

In accordance with the present invention, a shingle is provided to substantially reduce or eliminate the shortcomings previously associated with the appearance of composite and/or asphalt shingles. In accordance with one aspect of the present invention, a color gradient or gradation may be placed on portions of a shingle to create the illusion of thickness or depth on a relatively flat surface. The resulting shingle has the appearance of depth or thickness associated with wood shingles. The present invention may be used with laminated shingles having tabs or dragon teeth extending from a first sheet or dragon tooth strip with the tabs disposed on top of a second shingle sheet or backer strip.

In accordance with another aspect of the present invention, a shingle is provided having an exposed surface or weather surface with alternating portions of relatively uniform color adjacent to portions having a colored gradient from light to dark. If desired, the relatively uniform color portions or first color portions may vary in contrast with respect to each other and the color gradient portions or the second color portions may also vary with respect to each other. One embodiment of the present invention includes a laminated shingle having a plurality of dragon teeth with openings therebetween. A backer strip is preferably disposed under the dragon teeth with portions of the backer strip exposed through the openings between the dragon teeth. Each dragon tooth preferably has a relatively uniform color. The exposed portions of the associated backer strip preferably have a color gradient from light to dark to create the illusion of depth. The color gradient may be formed by a plurality of horizontal striations on the backer strip. The number and width of horizontal striations formed on the backer strip may be varied to provide the desired transition in color and contrast from light to dark to create the illusion of depth or thickness.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
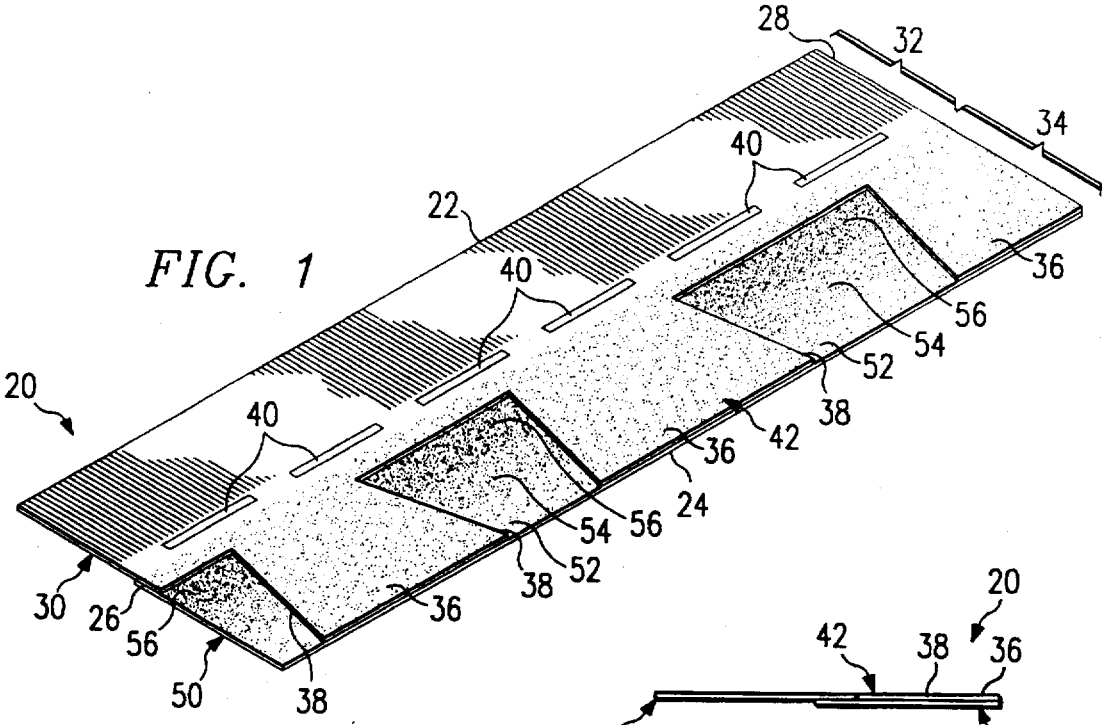
FIG. 1 is a perspective view of a single laminated shingle incorporating one embodiment of the present invention.
Figure 4:
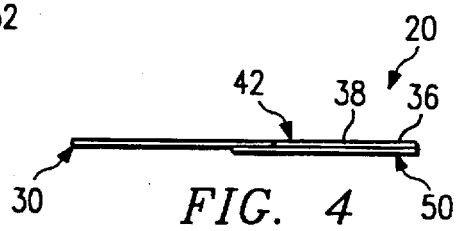
FIG. 4 is a left side view of the shingle of FIG. 1.
Figure 2:
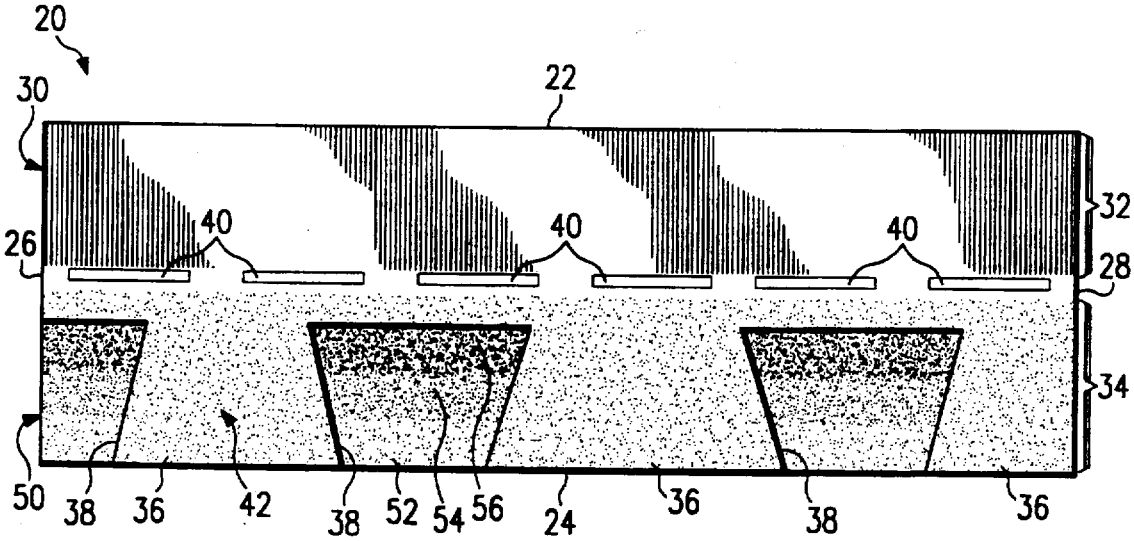
FIG. 2 is a top plan view of the shingle of FIG. 1.
Figure 3:
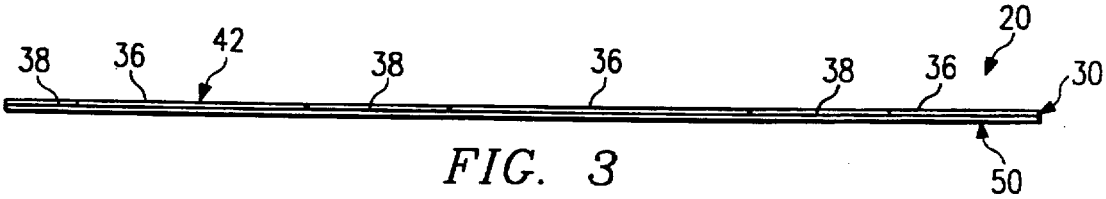
FIG. 3 is a front plan view of the shingle of FIG. 1.

The preferred embodiments of the present invention and its advantages are best understood by referring to FIGS. 1–7 of the drawings, like numerals being used for like and corresponding parts of the various drawings.

Laminated shingle 20 incorporating one embodiment of the present invention is shown in FIGS. 1–4. Laminated shingle 20 preferably comprises first shingle sheet 30 and second shingle sheet 50, which cooperate with each other to provide headlap section 32 and buttlap section 34. First shingle sheet 30 has a generally rectangular configuration comprising headlap section 32 with a plurality of tabs 36 extending therefrom to partially define buttlap section 34. Tabs 36 may also be referred to as "dragon teeth". A plurality of openings 38 are formed between adjacent tabs 36. Second shingle sheet 50 also has a generally rectangular configuration and is disposed beneath tabs 36 with portions of second shingle sheet 50 exposed through the associated openings 38.

Various techniques such as a self-sealing adhesive strip (not shown) may be used to attach second shingle sheet 50 to the underside of first shingle sheet 30. The resulting laminated shingle 30 has a generally rectangular configuration defined in part by longitudinal edges 22 and 24 with lateral edges 26 and 28 disposed therebetween. Longitudinal edge 22 defines in part the upper edge of the resulting laminated shingle 20. Longitudinal edge 24 defines in part the lower edge or leading edge of laminated shingle 20. A plurality of self sealing adhesive strips 40 are preferably disposed on the exterior of first shingle sheet 30 between headlap section 32 and buttlap section 34.

First shingle sheet 30 may sometimes be referred to as a "dragon tooth sheet". Second shingle sheet 50 may sometimes be referred to as a "backer strip". Also, openings 38 formed between adjacent tabs 36 with portions of backer strip 50 disposed thereunder may sometimes be referred to as "valleys." Depending upon the desired application and appearance of each shingle 20, tabs 36 may have equal or different widths and may have a square, rectangular, trapezoidal, or any other desired geometric configuration. In the same respect, openings 38 may have equal or different widths and may have a square, rectangular, trapezoidal or any other desired geometric configuration. As will be explained later in more detail, laminated shingles 20 may be formed from sheet 80 of roofing material shown in FIG. 6 with tabs 36 and opening 38 formed as a "reverse image" of each other.

For one embodiment of the present invention, laminated shingle 20 may be formed from a fiberglass matt (not shown) with an asphalt coating on both sides of the matt. If desired, the present invention may also be used with shingles formed from organic felt or other types of base material. The present invention is not limited to use with shingles having a fiberglass matt.

The exposed outer surface or weather surface 42 for shingle 20 is defined in part by tabs 36 and the portions of backer strip 50 which are exposed through openings 38 between adjacent tabs 36. Weather surface 42 of laminated shingle 20 may be coated with various types of mineral granules to protect the asphalt coating, to add color to laminated shingle 20 and to provide fire resistance. For some applications, ceramic coated mineral granules may be used to form the outer layer comprising weather surface 42. Also, a wide range of mineral colors from white and black to various shades of red, green, brown and any combination thereof may be used to provide a roof having the desired color for shingle 20. The underside of shingle 20 may be coated with various inert minerals with sufficient consistency to seal the asphalt coating.

An important feature of the present invention includes providing a plurality of horizontal striations on the surface of backer strip 50 which is exposed through openings 38. For the embodiment of the present invention shown in FIGS. 1 through 4, backer strip 50 has three horizontal striations 52, 54 and 56. These horizontal striations 52, 54 and 56 provide a color gradient or gradation from light starting at leading edge 24 to dark at the upper portion of each opening 38.

The number of horizontal striations and the width of each striation on backer strip 50 may be varied depending upon the desired aesthetic appearance of the resulting laminated shingle 20. For some applications, the color gradient formed on backer strip 50 may include ten or fifteen striations with each striation having a width of one quarter of an inch to one half an inch. Also, each striation may have a different color and tone to establish the desired amount of contrast. Contrast for purposes of this patent application is defined as the degree of difference in the tone or shading between areas of lightest and darkest color.

For some applications, a gradual change in contrast associated with a large number of striations may provide the appearance of depth or thickness associated with wood or other natural products. Also, the amount or degree of contrast in the color gradient exposed in each opening 38 may be varied depending upon the desired aesthetic appearance. An important feature of the present invention is the ability to vary the color gradient and the amount of contrast to provide the desired illusion or appearance of thickness on the finished roof.

Figure 5:
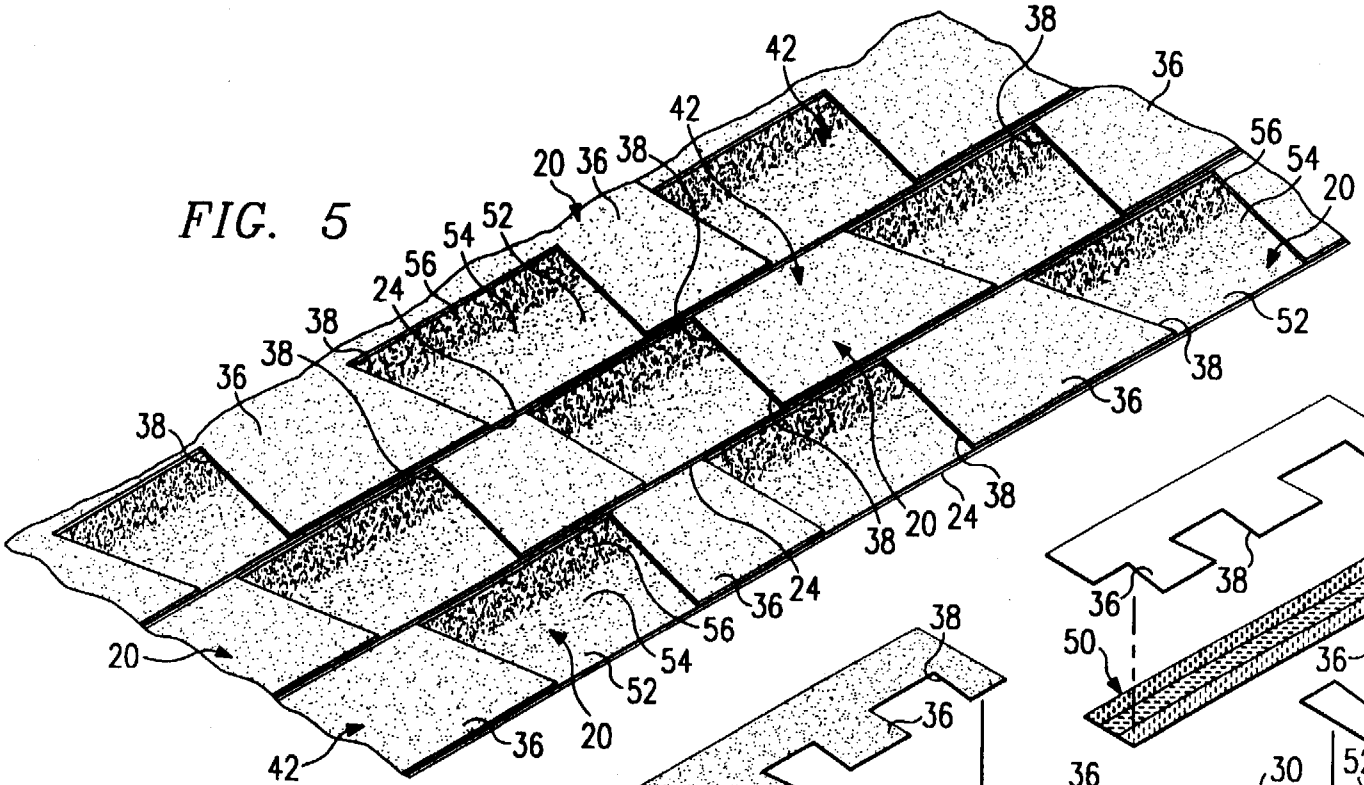
FIG. 5 is a perspective view of a partial roofing section covered with shingles incorporating one embodiment of the present invention.

As best shown in FIG. 5, a plurality of laminated shingles 20 may be installed on a roof or other structure (not shown) to provide protection from the environment and to provide an aesthetically pleasing appearance. The normal installation procedures for laminated shingle 20 include placing each shingle 20 on a roof with an overlapping configuration. Typically, buttlap section 34 of one shingle 20 will be disposed on the headlap section of another shingle 20. Self-sealing adhesive strips 40 are used to secure the overlapping shingles 20 with each other. Also, a limited lateral offset is preferably provided between horizontally adjacent rows of shingle 20 to provide an overall aesthetically pleasing appearance for the resulting roof.

Figure 7:
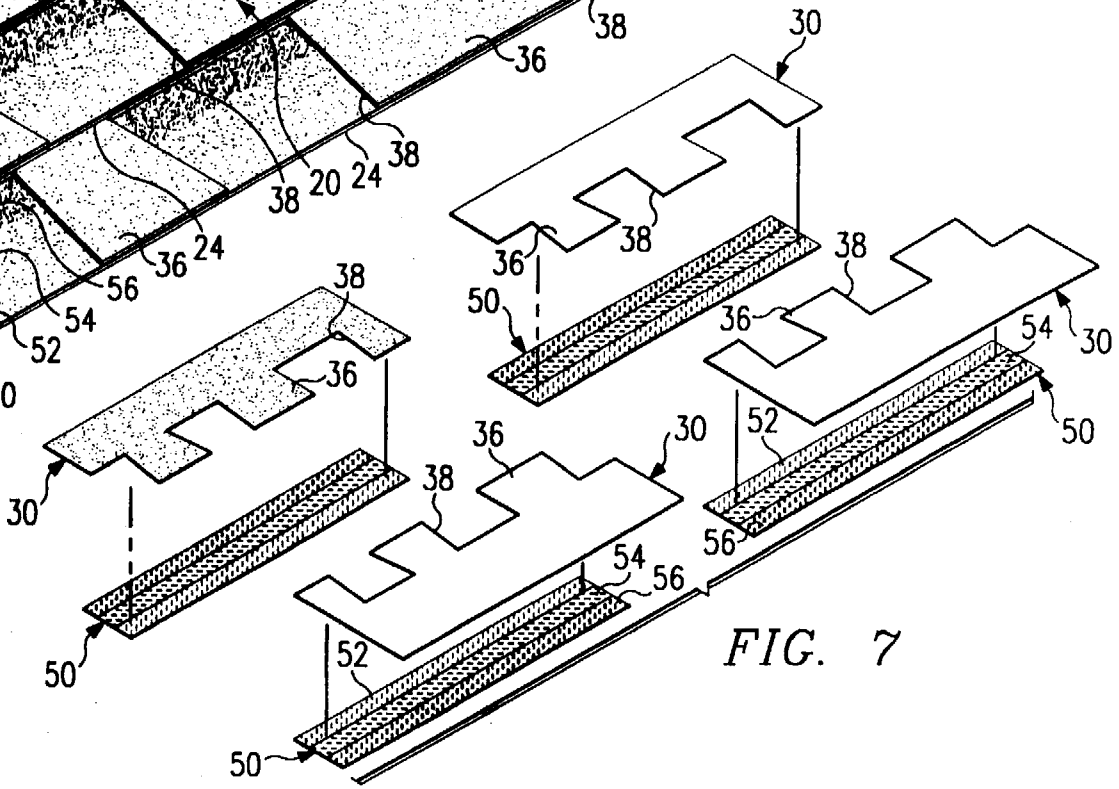
FIG. 7 is an exploded isometric view showing components taken from the sheet of roofing material in FIG. 6 which may be used to form the shingle of FIG. 1.
Figure 6:
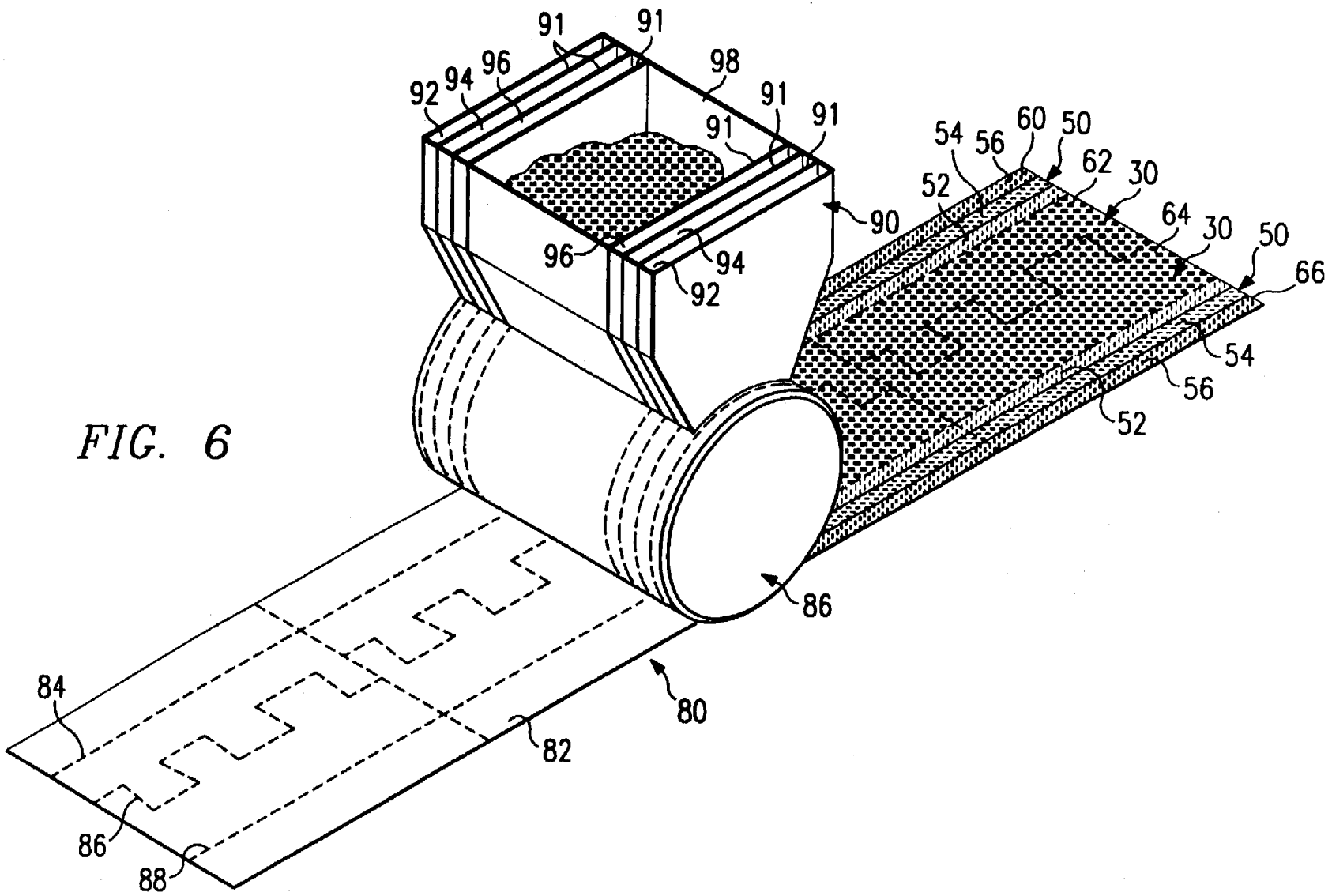
FIG. 6 is an isometric, schematic drawing with portions broken away of a sheet of roofing material incorporating one embodiment of the present invention from which components for the shingle of FIG. 1 may be obtained.

FIGS. 6 and 7 show one procedure for fabricating laminated shingle 20 from sheet 80 of roofing material. Various procedures and methods may be used to manufacture sheet 80 of roofing material from which shingles incorporating the present invention may be fabricated. Examples of such procedures are contained in U.S. Pat. No. 1,722,702 entitled *Roofing Shingle;* U.S. Pat. No. 3,624,975 entitled *Strip Shingle of Improved Aesthetic Character;* U.S. Pat. No. 4,399,186 entitled *Foam Asphalt Weathering Sheet for Rural Roofing Siding or Shingles;* and U.S. Pat. No. 4,405,680 entitled *Roofing Shingle*. Each of these preceding patents is incorporated by reference for all purposes within this application.

Sheet 80 is preferably formed from a fiberglass matt placed on a jumbo roll (not shown) having a width corresponding to sheet 80. Laminated shingles 20 are typically fabricated in a continuous process starting with the jumbo roll of fiberglass matt. As previously noted, laminated shingle 20 may also be fabricated using organic felt or other types of base material.

Sheet 80 shown in FIG. 6 preferably comprises a fiberglass matt with an asphalt coating which both coats the fibers and fills the void spaces between the fibers. A powdered limestone stabilizer (not shown) may be included as part of the asphalt coating process. A smooth surface of various inert minerals of sufficient consistency may be placed on the bottom surface of sheet 80 to seal the asphalt coating.

Top surface 82 is preferably coated with a layer of mineral granules such as ceramic coated stone granules to provide the desired uniform color portions and the color gradient portions associated with weather surface 42 of shingle 20. FIG. 6 shows a schematic representation of roller 86 and mineral granular hopper 90 which may be used to provide the desired granular surface coating to sheet 80. Hopper 90 includes a plurality of partitions 91 which divide storage bin 90 into compartments 92, 94, 96 and 98. The larger compartment or central compartment 98 of hopper 90 contains a uniform mixture of the mineral granules which will produce the desired color on dragon teeth or tabs 36 and the other portions of first shingle sheet 30 which will be exposed to the environment. This transfer of mineral granules is sometimes referred to as a "color drop."

For the embodiment of the present invention shown in FIGS. 6 and 7, each first shingle sheet 30 will have the same uniform mixture of mineral granules on both the headlap section and the buttlap section. For the embodiment shown in FIGS. 1 through 4, headlap section 32 may have the same layer of mineral granules as buttlap section 34 or headlap section 32 may have a neutral or noncolored layer of mineral granules. As previously noted, an important feature of the present invention includes providing at least one portion of weather surface 42 having a relatively uniform color and another portion of weather surface 42 having a color gradient from light to dark to create the appearance of depth or thickness on the associated portion of weather surface 42. The surface layer on headlap section 32 may be varied as desired for each application.

Different colored mineral granules corresponding to the desired horizontal striations 52, 54 and 56 are preferably placed in the appropriate compartments 92, 94 and 96. As sheet 80 passes under roller 86, mineral granules from the appropriate compartment in hopper 90 will fall onto roller 86 and be transferred from roller 86 to top surface 82 of sheet 80. The volume or pounds per square foot of mineral granules placed on surface 82 is preferably the same throughout the full width of sheet 80. However, by dividing hopper bin 90 into compartments, the color of various portions of sheet 80 may be varied including providing horizontal striations 52, 54, and 56 for backer strip 50.

It is important to note that conventional procedures for fabricating shingles having an exterior surface formed by mineral granules include the use of granule blenders and color mixers, along with other sophisticated equipment to ensure a constant uniform color at each location on the exposed portions of the shingles. Extensive procedures are used to ensure that each color drop on a sheet of roofing material is uniform. The color drop between shingles may be varied to provide different shades or tones in color. However, within each color drop, concerted efforts have traditionally been made to insure uniformity of the color on the resulting shingle associated with each color drop.

As shown by dotted lines 84, 86, and 88 in FIG. 6, sheet 80 may be cut into four horizontal lengths or lanes 60, 62, 64, and 66. The width of lanes 62 and 64 corresponds with the desired width for first shingle sheet 30. The width of lanes 60 and 66 correspond with the desired width for second shingle sheet 50. Lanes 60, 62, 64, and 66 may then be cut laterally to correspond with the desired length for the resulting first shingle sheet 30 and second shingle sheet 50. The rotation of roller 86 and the movement of sheet 80 are coordinated to place the desired color drop on each shingle 20.

The cut along dotted line 86 corresponds with the desired pattern for dragon teeth 36 and associated openings 38. For some applications, eight lanes may be cut from a sheet of roofing material similar to sheet 80. The number of lanes is dependent upon the width of the respective sheet of roofing material and the desired width of the resulting shingles.

As shown in FIG. 7, each lateral cut of sheet 80 results in two backer strips 50 and two first shingle sheets 30 which may be assembled with each other to form two laminated shingles 20. The resulting laminated shingles 20 are then packaged with the desired color configuration for future installation on a roof.

It is important to note that a color gradient of the present invention may be placed on shingles using various procedures and various types of materials. The present invention is not limited to shingles formed by the process shown in FIGS. 6 and 7.

Although the present invention and its advantages have been described in detail, it should be understood that various changes, substitutions and alterations can be made therein without departing from the spirit and scope of the invention as defined by the appended claims.

What is claimed is:

1. A laminated roofing shingle for enhancing the appearance of depth of the shingle comprising:

a first shingle sheet providing a plurality of tabs extending from an edge thereof, said tabs spaced apart to define a plurality of openings between said tabs;

a layer of colored mineral granules disposed on said tabs;

the color of said mineral granules on said tabs being relatively uniform throughout each tab;

a second shingle sheet disposed beneath and attached to the underside of said first shingle sheet to form a two-ply laminated shingle, with a layer of colored mineral granules disposed on said second shingle sheet and portions of said second shingle sheet having said colored mineral granules being exposed through said openings between said tabs;

first, second and third horizontal rectangular striations of said colored mineral granules on said second shingle sheet providing a color gradation across said portions of said second sheet which are exposed through said openings between said tabs;

said first striation providing an elongated generally quadrilateral area occupying the top of said portions of said second sheet, said first striation having a color substantially uniform throughout said generally quadrilateral area;

said second striation providing an elongated generally quadrilateral area occupying the middle of said portions of said second sheet, said second striation having a color lighter than the color of said first striation and said lighter color being substantially uniform throughout said generally quadrilateral area;

said third striation providing an elongated generally quadrilateral area occupying the bottom of said portions of said second sheet, said third striation having a lighter color than the color of said second striation and said lighter color being substantially uniform throughout said generally quadrilateral area; and said first, second and third horizontal stations providing a color gradation over each of said portions of said second shingle sheet which are exposed through said openings between said tabs, such that an appearance of shingle depth is created by the combined visual appearance of the color contrasts and gradations provided by said first and second shingle sheets.

2. A laminated roofing shingle for enhancing the appearance of depth of the shingle comprising:

a first shingle sheet providing a plurality of tabs extending from an edge thereof, said tabs spaced apart to define a plurality of openings between said tabs;

a layer of colored mineral granules disposed on said tabs;

the color of said mineral granules on said tabs being relatively uniform throughout each tab;

a second shingle sheet disposed beneath and attached to the underside of said first shingle sheet to form a two-ply laminated shingle, with a layer of colored mineral granules disposed on said second shingle sheet and portions of, said second shingle sheet having said colored mineral granules exposed through said openings between said tabs;

first, second and third horizontal rectangular striations of said colored mineral granules on said second shingle sheet providing a color gradation across said portions of said second sheet which are exposed through said openings between said tabs;

said first striation providing an elongated generally quadrilateral area occupying approximately the top one third of said portions of said second sheet, said first striation having a color substantially uniform throughout said generally quadrilateral area;

said second striation providing an elongated generally quadrilateral area occupying approximately the middle one third of said portions of said second sheet, said second striation having a color lighter than the color of said first striation and said lighter color being substantially uniform throughout said generally quadrilateral area;

said third striation providing an elongated generally quadrilateral area occupying approximately the bottom one third of said portions of said second sheet, said third striation having a lighter color than the color of said second striation and said lighter color being substantially uniform throughout said generally quadrilateral area; and said first, second and third horizontal striations of said colored mineral granules providing a color gradation over each of said portions of said second shingle sheet which are exposed through said openings between said tabs, such that an appearance of shingle depth is created by the combined visual appearance of the color contrasts and gradations provided by said first and second shingle sheets.

3. A laminated roofing shingle for enhancing the appearance of depth of the shingle comprising:

a first shingle sheet providing a plurality of tabs extending from an edge thereof, said tabs spaced apart to define a plurality of openings between said tabs;

a layer of colored mineral granules disposed on said tabs;

the color of said mineral granules on said tabs being relatively uniform throughout each tab;

the color of said mineral granules on different tabs having different color contrasts from one another;

a second shingle sheet disposed beneath and attached to the underside of said first shingle sheet to form a two-ply laminated shingle, with a layer of colored mineral granules disposed on said second shingle sheet and portions of said second shingle sheet having said colored mineral granules exposed through said openings between said tabs;

first, second and third horizontal rectangular striations of said colored mineral granules on said second shingle sheet providing a color gradation across said portions of said second sheet which are exposed through said openings between said tabs;

said first striation providing an elongated generally quadrilateral area occupying the top of said portions of said second sheet, said first striation having a color substantially uniform throughout said generally quadrilateral area;

said second striation providing an elongated generally quadrilateral area occupying the middle of said portions of said second sheet, said second striation having a color lighter than the color of said first striation and said lighter color being substantially uniform throughout said generally quadrilateral area;

said third striation providing an elongated generally quadrilateral area occupying the bottom of said portions of said second sheet, said third striation having a lighter color than the color of said second striation and said lighter color being substantially uniform throughout said generally quadrilateral area; and said first, second and third horizontal striations of said colored mineral granules providing a color gradation over each of said portions of said second shingle sheet which are exposed through said openings between said tabs, such that an appearance of shingle depth is created by the combined visual appearance of the color contrasts and gradations provided by said first and second shingle sheets.

4. A laminated roofing shingle for enhancing the appearance of depth of the shingle comprising:

a first shingle sheet providing a plurality of tabs extending from an edge thereof, said tabs spaced apart to define a plurality of openings between said tabs;

a layer of colored mineral granules disposed on said tabs;

the color of said mineral granules on said tabs being relatively uniform throughout each tab;

a second shingle sheet disposed beneath and attached to the underside of said first shingle sheet to form a two-ply laminated shingle, with a layer of colored mineral granules disposed on said second shingle sheet and portions of said second shingle sheet having said colored mineral granules exposed through said openings between said tabs;

first, second and third horizontal rectangular striations of said colored mineral granules on said second shingle sheet providing a color gradation across said portions of said second sheet which are exposed through said openings between said tabs;

said first striation providing an elongated area occupying the top of said portions of said second sheet, said first striation having a color substantially uniform throughout said elongated area;

said second providing an elongated area occupying the middle of said portions of said second sheet, said second striation having a color lighter than the color of said first striation and said lighter color being substantially uniform throughout said elongated area;

said third striation providing an elongated area occupying the bottom of said portions of said second sheet, said third striation having a lighter color than the color of said second striation and said lighter color being substantially uniform throughout said elongated area;

said first, second and third horizontal striations of said colored mineral granules providing a color gradation over each of said portions of said second shingle sheet which are exposed through said openings between said tabs, such that an appearance of shingle depth is created by the combined visual appearance of the color contrasts and gradations provided by said first and second shingle sheets; and the dimensions of one of said tabs and said openings formed thereby differ from the dimensions of other of said tabs and said openings formed thereby.

5. A laminated roofing shingle for enhancing the appearance of depth of the shingle comprising:

a first shingle sheet providing a plurality of tabs extending from an edge thereof, said tabs spaced apart to define a plurality of openings between said tabs;

a layer of colored mineral granules disposed on said tabs;

the color of said mineral granules on said tabs being relatively uniform throughout each tab;

a second shingle sheet disposed beneath and attached to the underside of said first shingle sheet to form a two-ply laminated shingle, with a layer of colored mineral granules disposed on said second shingle sheet and portions of said second shingle sheet having said colored mineral granules exposed through said openings between said tabs;

at least first, second and third horizontal rectangular striations of said colored mineral granules on said second shingle sheet providing a color gradation across said portions of said second sheet which are exposed through said openings between said tabs;

said first striation providing a first elongated area occupying the top of said portions of said second sheet, said first striation having a color substantially uniform throughout said first elongated area;

said second striation providing a second elongated area on said portions of said second sheet adjacent to said first elongated area, said second striation having a color lighter than the color of said first striation and said lighter color being substantially uniform throughout said second elongated area;

said third striation providing a third elongated area on said portions of said second sheet adjacent to said second elongated area, said third striation having a lighter color than the color of said second striation and said lighter color being substantially uniform throughout said third elongated area; and said first, second and third horizontal striations of said colored mineral granules providing a color gradation over said portions of said second shingle sheet which are exposed through said openings between said tabs, such that an appearance of shingle depth is created by the combined visual appearance of the color contrasts and gradations provided by said first and second shingle sheets.

* * * * *

UNITED STATES PATENT AND TRADEMARK OFFICE

CERTIFICATE OF CORRECTION

PATENT NO. : 5,666,776

DATED : September 16, 1997

INVENTOR(S) : Weaver, *et al.*

It is certified that error appears in the above-identified patent and that said Letters Patent is hereby corrected as shown below:

Column 7, line 9, after "horizontal", delete "stations" and insert -- striations--.

Column 7, line 28, after "of", delete ",".

Signed and Sealed this

Twenty-fourth Day of February, 1998

*Attest:*

Bruce Lehman

BRUCE LEHMAN

*Attesting Officer*

*Commissioner of Patents and Trademarks*